US005942714A

United States Patent [19]

Oberlin et al.

[11] Patent Number: 5,942,714

[45] Date of Patent: Aug. 24, 1999

[54] ACCURATE ULTRA LOW POWER FUZE ELECTRONICS

[75] Inventors: Richard P. Oberlin, Phoenix; Robert T. Soranno, Baldwin, both of Md.

[73] Assignee: AAI Corporation, Cockeysville, Md.

[21] Appl. No.: 09/002,247

[22] Filed: Dec. 31, 1997

[51] Int. Cl.[6] ..... F42C 9/14

[52] U.S. Cl. ..... 89/6.5; 102/210; 102/211; 102/216

[58] Field of Search ..... 89/6, 6.5; 102/216, 102/220, 210, 211, 266, 221

[56] References Cited

U.S. PATENT DOCUMENTS

| | | | |
|---|---|---|---|
| 3,760,732 | 9/1973 | Schuster et al. | 244/3.19 |
| 4,984,519 | 1/1991 | Ochi et al. | 102/220 |
| 5,363,765 | 11/1994 | Aikou et al. | 102/220 |

FOREIGN PATENT DOCUMENTS

| | | | |
|---|---|---|---|
| 3301251 | 6/1984 | Germany | 89/6 |
| 2221284 | 1/1990 | United Kingdom . | |

*Primary Examiner*—Stephen M. Johnson
*Attorney, Agent, or Firm*—Venable, Baetjer, Howard & Civiletti, LLP

[57] ABSTRACT

An accurate, yet ultra low power fuse electronics is presented in which two methods are used to reduce power consumption in the fuze electronics. First, the fuze uses low power 3.3 volt logic chips ("LV" series or equivalent CMOS logic chips) along with switches that have low input capacitance and low quiescent current. Second, a circuit design is used which, while still accomplishing the objects of the invention, drastically reduces the number of electronic elements required. When a projectile is fired from a weapon, a fire control system transmits a signal to a data conditioner located on the projectile. The data conditioner demodulates and filters the signal, producing a burst time data word which is transmitted to a microcontroller. The data conditioner is comprised of passive components, therefore no supply power is required. The microcontroller decodes the data word and also uses the data word to correct any error in the high and low speed fuze oscillators. The microcontroller then converts the data word to a count down. At the end of count clown, the microcontroller transmits a signal to the detonator, thereby exploding the projectile. Power is supplied to the fuze electronics by a power conditioner's function which takes energy input from a fast rise piezoid and apportions it to the fuze electronics. The detonator utilizes a low power MOSFET or SCR switch and the power conditioner uses a low power CMOS DC/DC converter.

17 Claims, 6 Drawing Sheets

ACCURATE ULTRA LOW POWER FUZE ELECTRONICS

CROSS REFERENCE TO RELATED APPLICATIONS

This application is related to the following applications: "One-Shot High-Output Piezoid Power Supply" (U.S. Ser. No.: 09/001,687) by Richard P. Oberlin; and Robert T. Soranno; "Ultra Low-Power Fast Start Precision Oscillator" (U.S. Ser. No.: 09/001,690) by Richard P. Oberlin; "Muzzle Velocity Sensor" (U.S. Ser. No.: 09/001,694) by Richard P. Oberlin and Doug R. Cullison; "Self Correcting Inductive Fuze Setter" (U.S. Ser. No.: 09/001,693) by Richard P. Oberlin and Robert T. Soranno; and "Piezoid Electrical Gun Trigger" (U.S. application Ser. No.: 09/001,688) by Richard P. Oberlin, each of which is filed concurrently herewith, commonly owned, and incorporated herein by reference.

BACKGROUND OF THE INVENTION

The present invention relates to a new and improved fuze design that uses considerably less power than fuze designs disclosed in prior art. For instance, a low power CMOS timer used in AAI Corporation's TAFF device dissipates about 400 uA at 54 kHz and is projected to draw about 63 uA if operated at 8 kHz. Furthermore, when microcontrollers are included in the countdown circuit design, even more power is consumed. As a result, either batteries must be included in the design or else a significant pre-charge must be placed on a relatively large capacitor.

The problem with using batteries is that they must meet a 20 year life requirement. Therefore, they are kept in an inert state until activated. Consequently, a delay from 50 to 500 msec or more is encountered after firing of a projectile from a weapon before the battery comes up to a useable level. Electrical energy has to be temporarily supplied by some other means if the fuze electronics has to operate before that time. This results in a higher cost per round and raises reliability and safety concerns. At the present time, no electronic fuze presently exists that can operate from a piezoid alone for count down times of several seconds or more.

SUMMARY OF THE INVENTION

It is a primary object of this invention to produce a new and improved fuze design that uses considerably less power than fuze designs disclosed in prior art.

Another and more specific object of the present invention is to provide a fuze electronic hardware design that can reliably operate at least 10 seconds with a total energy budget of 30,000 ergs or less (to permit powering by a piezoid alone) and, in addition provide: (1) programmability for time and/or function; (2) adaptability to various projectile sizes and needs; (3) inductive data transfer capability of 208 Kbps; (4) automatic oscillator calibration to better than ±0.1%(−40° C. to +60° C.); (5) start-up to operational accuracy in 1.5 msec or less after firing; (6) back-up, independent point detonation; (7) capable of being packaged in a volume not to exceed 0.6" in diameter by 0.25" long (not including power sources or detonator); (8) capable of being hardened to withstand 60,000 g's launch environment; and (9) capable of being production engineered to have a production unit cost of fuze design that uses considerably less power than fuze designs disclosed in prior art.<$10.00 each in quantities of $10_6$ per month.

The invention will be better understood and objects other than those set forth above will become apparent when consideration is given to the following detailed description thereof. Such description makes reference to the annexed drawings wherein throughout the various figures of the drawings, there have been generally used the same reference terminology to denote the same or analogous components and specifically wherein:

DETAILED DESCRIPTION OF THE PREFERRED EMBODIMENTS

A description of the accurate ultra low power fuze electronics and its operation according to the present invention follows. A top level block diagram is presented first and then a detailed configuration of each block and its contribution to decreasing current consumption is discussed.

At time=0 a projectile is fired from the muzzle of a weapon. A typical peak acceleration of 30,000 g is reached in about t=0.5 msec. This acceleration acts upon a weight (usually the Safe and Arm assembly itself). The weight then compresses a piezoid in the projectile; thereby causing it to generate electrical energy (see the One Shot High Output Piezoid patent disclosure for details). The piezoid power supply is connected and electrically coupled to a power conditioner which conditions the electrical energy and then supplies this conditioned energy to the fuze electronics located on the projectile at about t=1.5 msec.

Figure 1:
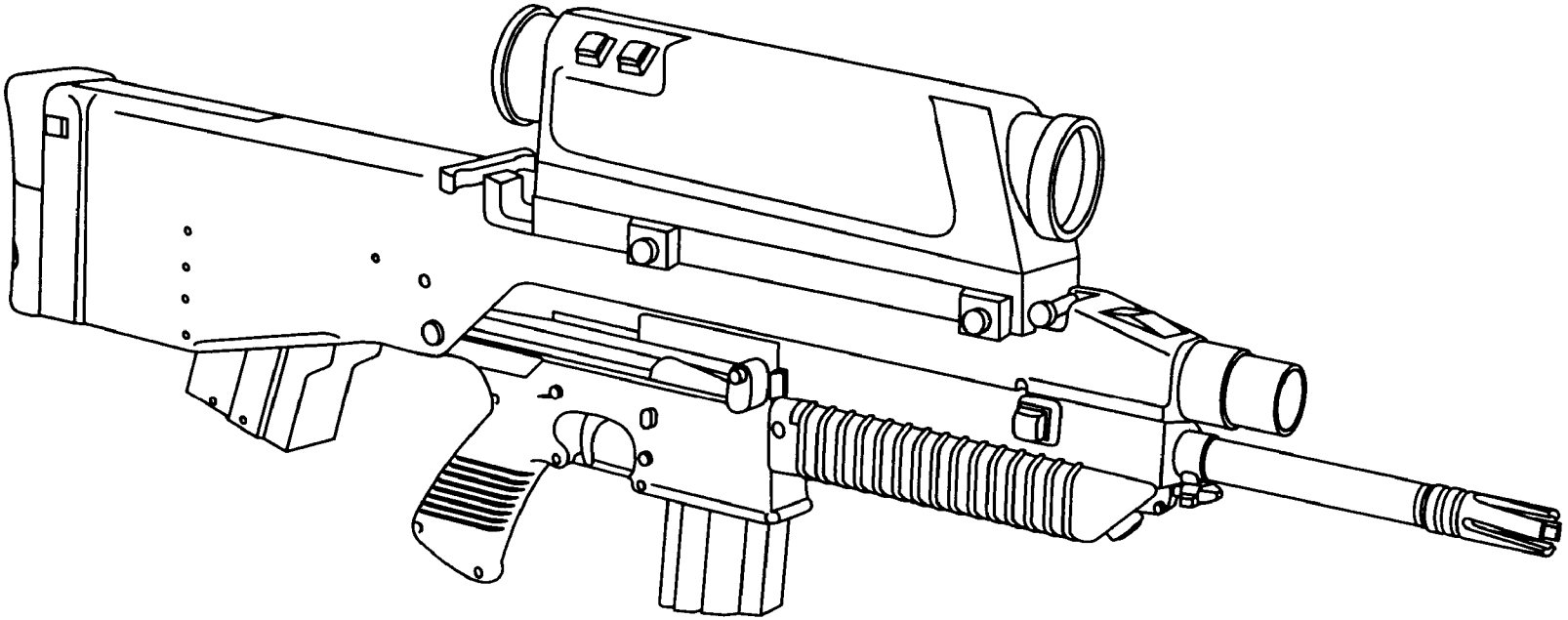
FIG. 1 is a top, right-side perspective view of a combination weapon which utilizes the accurate low power fuze according to the present invention.
Figure 2:
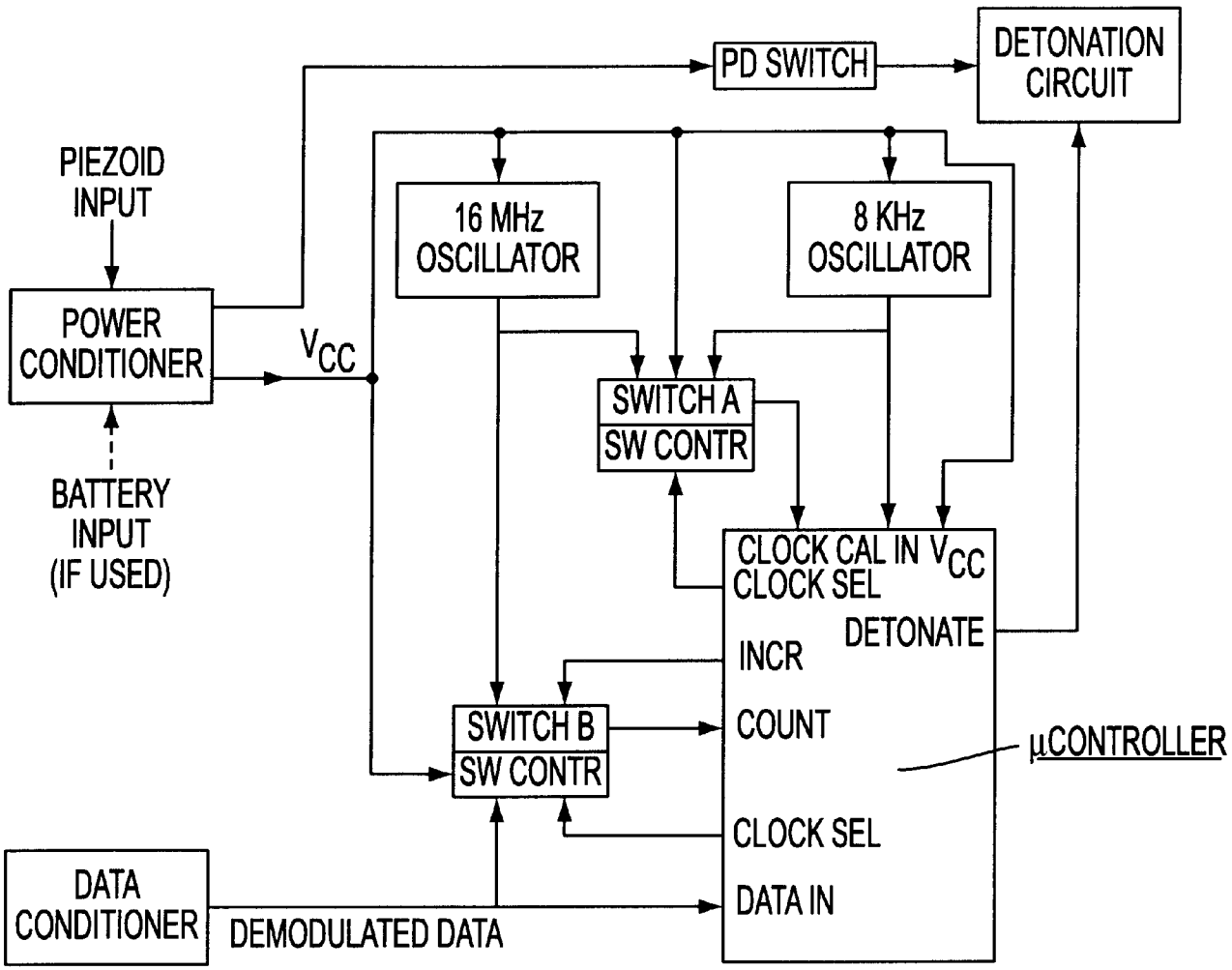
FIG. 2 is a block diagram of the accurate low power fuze.

In a preferred embodiment, a decoder circuit and an oscillator error correction circuit are both contained in a microcontroller (See FIG. 2). Two external switches are attached to the microcontroller, switch A and switch B. The switch control of switch A is connected to a first clock select input on the microcontroller and the switch control of switch B is connected to a second clock select input on the microcontroller. The output of switch A is connected to a clock input on the microcontroller. The output of switch B is connected to a count input of the microcontroller. The high speed fuse oscillator is connected to a first input of switch A and to a first input of switch B. The low speed fuze oscillator is connected to a second input of switch A. An increment output of the microcontroller is connected to a second input of switch B. The microcontroller sets the controls of switch A so that the high speed fuze oscillator (16 MHz in a preferred environment) is connected to the "clock" input of the microcontroller, thereby providing the "clock" signal for the microcontroller. At approximately t=1.7 msec, the microcontroller goes into a waiting state. At approximately 2.3 msec, the weapon's Fire Control System (FCS) transmits a modulated, encoded signal which is received by the data conditioner located in the fuze electronics. The output of the data conditioner is connected to a data input of the microcontroller and also, to a second input of the switch control of Switch B. The data conditioner demodulates the received signal producing an encoded burst time data word and outputs the encoded burst time data word to both the data input of the microcontroller and also, to the second input of the switch control of Switch B. The first rising edge of the encoded burst time data word activates the switch control of Switch B, thereby causing the high frequency clock pulses to be gated into the microcontroller "counter" input and simultaneously, interrupting the microcontroller thereby awakening it from its sleep/wait state. Furthermore, the encoded burst time data word is read into the "data" input of the microcontroller. After all the data bits are read in (20 bits in a preferred embodiment), the microcontroller deactivates the switch control of Switch B, thereby preventing anymore high frequency clock pulses from being gated into the microcontroller "counter" input. This occurs on the rising edge of the "end" bit that has no data associated with it. When the end bit arrives, at about t=2.4 msec, the count clock is stopped, the microcontroller is interrupted and no further inputs are accepted on the data input line. At this point, the encoded burst time data word is stored in memory in encoded form and the number of high frequency clocks used to clock in the burst time data word is contained in the microcontroller's counter.

Next, the microcontroller calculates the error contained in the high frequency fuze oscillator by activating an incremental count through switch control B (see FIG. 2), combines this result with the count in the counter and stores the result.

The microcontroller then calculates the error contained in the low frequency oscillator (8 kHz in a preferred embodiment) by internally counting instruction cycles for a given number of low frequency cycles (which are input to the microcontroller through the Cal Input), whereby it determines and stores low frequency clock error relative to the high frequency one. Once all this is done, the microcontroller decodes the stored burst time data word, checks for errors and corrects if possible. It then adjusts the burst time data word to compensate for both high fuze speed and low fuze speed oscillator error, turns off the high frequency oscillator via the switch control of switch A, subtracts processing time and starts the internal count down timer. This is all completed by about t=4.0 msec.

In a preferred embodiment, a battery is also input to the power conditioner (for extended time or for powering ancillary circuits) for supplying power thereto. It is also activated when the projectile is first fired (time t=0), but it doesn't come up to a useable level until a few hundred milliseconds later.

When the timer times out (which typically may be anywhere from 0.1 seconds to several seconds) or the PD switch is activated, the detonator is electrically fired. If the mechanical S & A (i.e., safe-and-arm) switch, which is not shown in FIG. 2, has activated, then the warhead is initiated by the detonator firing.

POWER CONDITIONER

The power conditioner's function is to first take the energy input from the a fast rise piezoid and apportion it out to the main storage capacitor, the detonator capacitor, the filter capacitor. Furthermore, it will supply energy to any circuits which might need a "jump start" to become operational in the required time. It then has to convert the stored energy (which typically starts at 11.5 volts and exponentially drops to about 3.5 volts over time) to a constant output voltage (typically 3.3 volts) for proper circuit operation. It performs all of these functions in the following manner.

Figure 3:
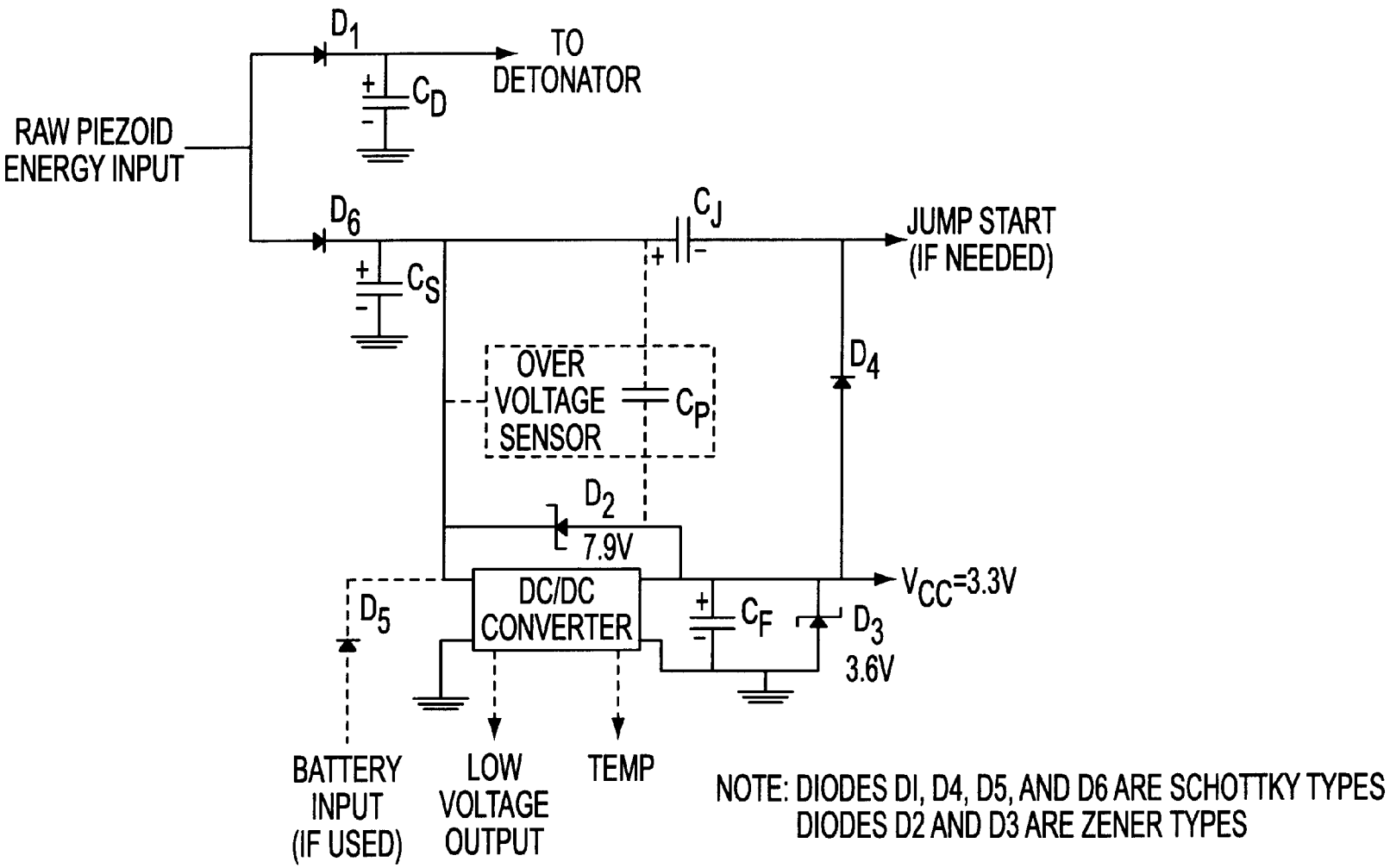
FIG. 3 is a schematic circuit diagram of the power conditioner.

Referring to FIG. 3, the piezoid energy source is connected to a storage capacitor, $C_S$ in the power conditioner, through isolation diode $D_6$. Capacitor $C_S$ serves as the main energy store. During setback, the piezoid charges $C_S$ directly and $C_D$ through their respective diodes $D_6$ and $D_1$. $C_D$ and $D_1$ are used to reserve energy for the detonator (and detonator circuits) so that it can be fired by a point detonation switch activation even if a malfunction depletes the energy stored on $C_S$.

Since the raw piezoid energy varies with temperature, set back force, mechanical tolerances and piezoid material variations, it is selected to provide the required energy under worst case conditions, which means that most of the time it will over-generate energy. This is manifested as excessive voltage which can damage the low current electronics involved in the fuze design. The power conditioner prevents damage from excessive voltage in the following manner. The voltage on $C_S$ rises rapidly during the piezoid charging cycle. When it reaches 7.9 volts, the pre-charge Zener $D_2$ starts to conduct thus causing the power supply filter capacitor, $C_F$ to be charged as well. When the voltage on $C_F$ reaches 3.6 volts, Zener diode $D_3$ conducts and any excess piezoid energy will be dissipated by diodes $D_2$ and $D_3$.

At this point, $C_S$ and $C_D$ will be charged to 11.5 volts, and $C_F$ will be charged to 3.6 volts. It is necessary to pre-charge $C_F$ because there are no DC/DC converters available that can both charge the filter capacitor fast enough and yet operate reasonably efficiently at ultra low currents. Also, the Zener voltage on $D_3$ has to be set high enough to ensure that the Zener will not conduct normally when the DC/DC converter is putting out it's normal 3.3 volts or else energy will be wasted. Alternatively, diodes $D_2$ and $D_3$ can be replaced by electronic over-voltage circuits of various types to limit the voltages to 11.5 volts. In this embodiment, a pre-charge capacitor $C_P$ is required to bring the DC/DC converter output voltage up quickly.

Next, the power conditioner circuitry output, otherwise known a the supply voltage input or the $V_{CC}$ supply voltage input quickly returns to 3.3 volts from the initial 3.5 volts since the high speed circuits (16 MHz in preferred embodiment) are operating at this point and several milliamps of current are being drawn by the fuze electronics. $C_F$ should be kept as small as possible to minimize energy loss during charging, but a value of at least 10 uF is required to ensure DC/DC converter stability and to keep output ripple within reason on the $V_{CC}$ power bus.

In a preferred embodiment, the DC/DC converter used is a Maxim MAX640 with an external 500 uH switching inductor. The quiescent current of the MAX640 is nominally 10 uA and the efficiencies range from about 50% at an output current of 50 uA to about 85% at an output current of 10 mA.

In a preferred embodiment a jump start can be provided by the combination of CJ and D4 which gives an 11.5 volt jolt that decays quickly to about 3.0 volts (this voltage can be made equal to 3.3 volts if necessary, by using a MOSFET and a couple more components in place of diode $D_4$).

In a preferred embodiment a battery can be coupled in through diode $D_5$ (or again through a MOSFET switch and a couple more components for low drop). If a battery is used, then the DC/DC converter will use the piezoid energy until the piezoid voltage drops below the battery voltage. This provides a smooth and seamless transition and no energy is wasted in the process.

Typically, monolithic IC power supply chips provide a "low battery" indication when that input is below some preset level. This can be used to deactivate the microcontroller clear line and thus give a reliable start-up. A couple of resistors and a capacitor may be necessary to set this up, but this is one more resistor than required for the normal "clear" function and this feature can be had for almost free. In addition, the power supply IC can also provide temperature indication (in the form of a diode drop) which can be used to compensate for oscillator temperature drift if that is required.

DATA CONDITIONER

Inductive data transfer is made very robust in order to both provide a high reliability of data transfer and to minimize circuitry in the fuze electronics. As can be seen in the schematic diagram of FIG. 4, the data conditioner is comprised of passive components, therefore no supply power is required. In fact, if overdriven, the data pulses will put power into the fuze $V_{CC}$ line thus adding energy during data transfer. Furthermore, the output impedance of the data conditioner is low (on the order of a few hundred ohms), so that loading effects are negligible and noise immunity is very high.

Figure 4:
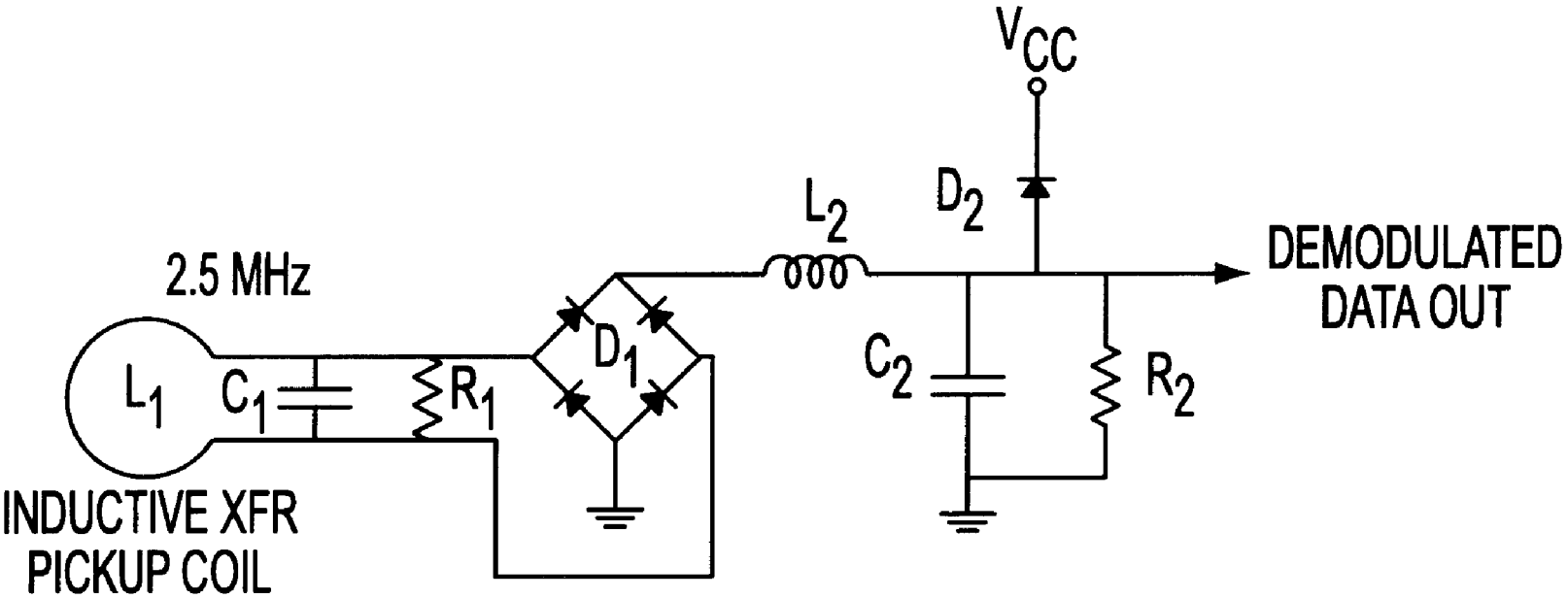
FIG. 4 is a schematic circuit diagram of the data conditioner used in the accurate low power fuze.

The following is a description of the Data Conditioner circuit which is shown in FIG. 4. A pickup coil $L_1$ is connected in parallel to a first capacitor $C_1$. In a preferred embodiment where the carrier frequency used to transmit the encoded word is 2.5 MHz, the pick-up coil consists of approximately 9 turns of small diameter copper wire. It has an inductance of about 5 uH. The associated tuning capacitor, $C_1$, has a capacitance of about 3000 pF. The unloaded "Q" of the pick-up coil in parallel with the capacitor is high. Therefore, it is adjusted down by placing a first resistor $R_1$ in parallel with the pick-up coil. In a preferred embodiment, a nominal resistance value of 430 ohms is selected.

After the signal is received by the pick-up coil, the received signal is then transmitted to a full wave Schottky bridge rectifier $D_1$ in series with an LC filter. The rectifier removes the carrier frequency from the amplitude modulated signal. Also, full wave rectification allows for a rapid rise time and efficient use of the received signal energy.

Because amplitude modulation of a carrier frequency is done by combining the carrier and the modulating signal through a nonlinear device, undesired frequency components are generated which must be filtered out. The LC filter is used to attenuate these undesired frequencies without unduly slowing the pulse rise time. In a preferred embodiment, the value of the inductor $L_2$, is 100 uH and the value of the second capacitor $C_2$ is 1000 pF.

A second resistor $R_2$ is placed in parallel with the second capacitor in the LC filter to provide damping to control the "Q" of the LC filter. A diode $D_2$ is connected between $V_{CC}$ and the output of the Data Conditioner to provide protection under conditions of data overdrive (which could overtax the ESD diodes inside the microcontroller). The excess energy is dumped into the $V_{CC}$ line where it supplies power to the fuze electronics for a short period of time.

LOW POWER EMBODIMENT

When the fuze electronics are operating at high speeds they will draw a relatively large amount of current. For example, every output from an IC running at high speed (16 MHz in a preferred embodiment) will draw approximately 2 mA at 3.3 volts due to having to charge and discharge stray capacitance (input capacity of the driven chip plus interconnecting wire capacitance). On the other hand, the current consumption of the fuze electronics must be very low (in the uA region) when operating at low speeds (in a preferred embodiment, the fuze electronics operate at 8 kHz), or else the current consumption during the long time out will be adversely affected. (It is necessary to use a high speed fuse clock at certain times because the data transfer and clock correction must be completed in a very short time frame. On the other hand, the fuze electronics must be switched to a low speed clock during count down because count down occurs over a relatively long period of time and a high speed clock would dissipate all energy before count down was completed). Two methods are used to reduce power consumption in the fuze electronics. First, the fuze setter uses 3.3 volt logic ICs, along with switches that have low input capacitance and low quiescent current. Secondly, a circuit design is used which, while still accomplishing the objects of the invention, drastically reduces the number of electronic elements required.

The first requirement was met by using the low voltage ("LV") series or equivalent complementary metal-oxide semiconductor (CMOS) logic chips, using a microcontroller made by the same process, and using low power/low voltage analog switches. The term "LV" is an acronym encompassing all newer lower voltage translated CMOS components designed to operate on 3.3 volts or lower, versus 5.0 volts for standard CMOS technology. In a preferred embodiment CMOS logic chips manufactured by National, Texas Instruments (TI) or Signetics were used, a 16C71 microcontroller made by Microchip was used, and low power/low voltage analog switches made by either Maxim or Analog Devices were used. The use of analog gates for switch A and switch B instead of digital switches reduces current consumption by 2 mA per chip for a 4 mA total. In a preferred embodiment switches A and B are Maxim MAX4544's.

The second requirement was met by designing the circuit in such a way so that the microcontroller performed as many functions as possible. This design minimized the number of devices in the high speed circuit, provided programming capability and reduced cost and current consumption. However, high speed/low speed oscillator switching, high speed fuze oscillator calibration, and data demodulation could not be included in the microcontroller and had to be provided by use of external electronics.

Figure 5B:
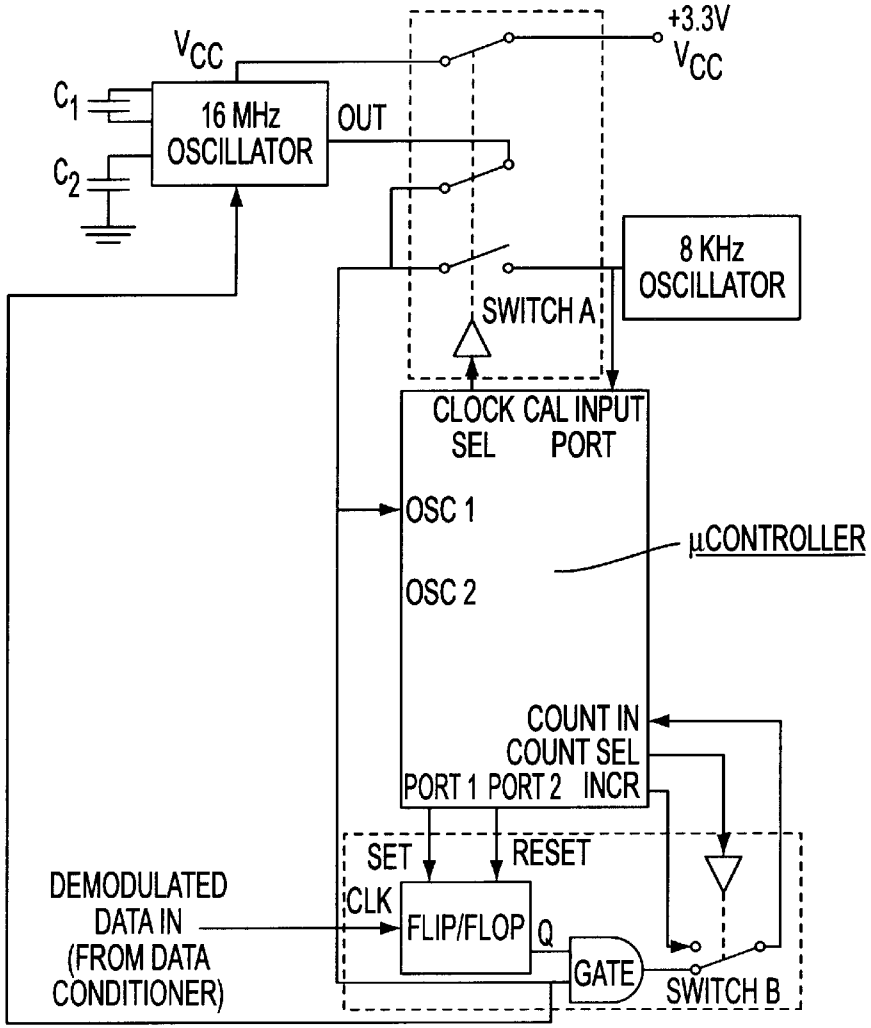
FIG. 5*b* is a schematic circuit diagram of the microcontroller along with its associated components and their interconnections, wherein a separate 16 MHz oscillator is provided.

In a preferred embodiment (see FIGS. 5*a* and 5*b*), switch B further comprises a flip/flop having a clock input, a Q output, a set control and a reset control, a high frequency gate having two inputs and one output, and a single pole/double throw switch. The single pole/double throw switch has one output connected to a count input on the microcontroller, a switch control connected to a count select input of the microcontroller, and two inputs. One input is connected to the increment output of the microcontroller and the other input is connected to the output of the high frequency gate.

The set control of the flip/flop is connected to a Port 1 output of the microcontroller. The reset control of the flip/flop is connected to a Port 2 output of the microcontroller. The clock input of the flip/flop is connected to the output of the data conditioner. The Q output of the flip/flop is connected to one input of the high frequency gate and the high speed fuze oscillator.

When high speed mode is selected, the microcontroller initializes all of its registers upon power up. In addition, it configures the input/output ports and resets all output registers. It then selects the high speed clock (16 MHz in a preferred embodiment) as its clock input.

Approximately 1.3 msec later the inductive data transfer is initiated by the Fire Control System (FCS) in the weapon from which the projectile was launched. The data conditioner receives the signal, demodulates and filters it (discussed above) and transmits the encoded burst time data word to the clock input of the flip/flop. When the leading edge of the first pulse is received, the flip-flop is toggled which activates the high frequency gate enabling the prescalar in the microcontroller to count high frequency clocks. It is necessary to do this to maintain a resolution of ±0.5 counts since the other microcontroller functions only handle increments of the clock/4 or 4 MHz resolution in a preferred embodiment.

The microcontroller responds to the first interrupt by first forcing the flip/flop to stay in the "set" state so that it isn't toggled "on" and "off" by subsequent data bits. It synchronizes itself with the first data bit, and all others, by referencing from the interrupts generated by the rising edges. Once the last data bit is read into memory (in a preferred embodiment 20 were used), the microcontroller removes the forcing "set" from the flip/flop allowing it to toggle on the next rising edge which is the "end" bit. This stops the count in the prescalar which, along with the microcontroller timer, contains the number of high frequency clocks that occurred during the precise 20 data bit transfer period (as determined by an accurate clock in the FCS). In a preferred embodiment, the count should be 1536±1 if the 16 MHz clock in the fuze is accurate; but, in any case, it indicates what the actual frequency is. This approach has been tested to its limits and can accommodate clocks that are anywhere within ±20% of nominal.

The microcontroller is also interrupted by the end bit. When that happens it puts the flip/flop in a perpetual reset state (to preserve the accumulated count), permanently shuts down the "Data In" interrupt port (which is the clock input on the flip/flop) and switches the count input to a specific microcontroller output port (the increment output). It then "increments" the prescalar slowly, one count at a time until the prescalar "rolls over" in order to determine the residual count (this is necessary because the prescalar is not readable within the microcontroller). Once this is accomplished, the high frequency count is adjusted accordingly and is stored in memory.

The microcontroller then activates the "Low Frequency Cal In" interrupt (the low frequency oscillator is connected to the Cal input port on the microcontroller). In a preferred embodiment, an 8 kHz oscillator is used and the microcontroller counts how many 4 MHz instruction cycles (derived from the 16 MHz clock) are contained within eight cycles of the 8 kHz clock. The nominal number is 4,000±1 and, whatever it is, it gives the relationship between the two oscillators. This is referenced back to the 16 MHz count and an 8 kHz oscillator correction factor is computed. This factor is used to adjust the stored count down time to compensate for oscillator error. The total compensation time to this point is subtracted from the adjusted time and the result put into the count-down timer.

As mentioned earlier, an analog gate is used for both switches A and B (in a preferred embodiment a MAX4544 is used). These switches are low current devices. Consequently, when the switch is closed it acts like a feed-through capacitor at high frequencies and, when the switch is open, it acts like a much smaller feed-through capacitor. Therefore, in the case of Switch A, the use of an analog switch effectively isolates the low speed fuze oscillator (in a preferred embodiment this oscillator is 8 kHz) from the microcontroller when the high speed fuze oscillator is selected as the input. In addition, it provides large isolation between the high speed fuze oscillator input and the low speed fuse oscillator inputs.

Figure 5A:
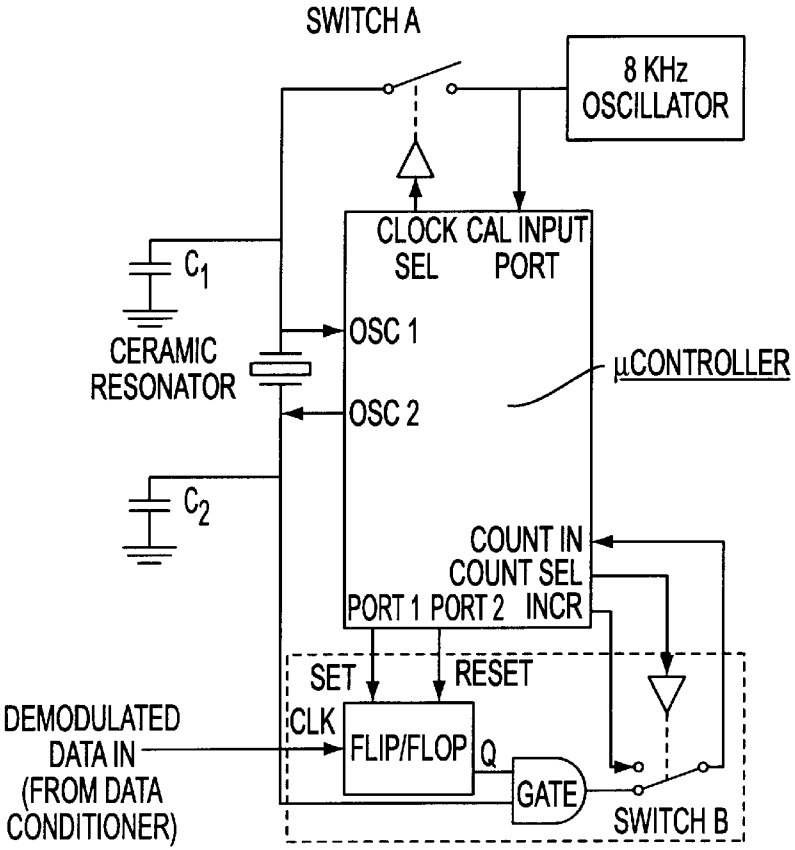
FIG. 5*a* is a schematic circuit diagram showing the microcontroller along with its associated components and their interconnections, wherein use of a ceramic resonator allows the 16 MHz oscillator to be integrated as part of the microcontroller.

In a preferred embodiment, a ceramic resonator was used as the high speed fuze oscillator (sec FIG. 5*a*). In another preferred embodiment, a surface mounted crystal was also tested in place of the ceramic resonator and worked satisfactorily (see FIG. 5*b*). Although the start up time was longer (about 2 msec), it was acceptable. However, survivability during set back has not been determined. The use of a crystal would eliminate the need for switch B and the associated software, although eliminating software is not a significant object of this invention.

In an alternative preferred embodiment, a discrete high speed CMOS fuze oscillator was used. (See FIG. 5*b*). The additional high speed fuze oscillator (16 MHz in a preferred embodiment) draws 2 mA more than the circuit shown in FIG. 5*a* and requires an additional two more analog switches. The only advantage of this approach is that the die form of the added oscillator is physically much smaller than the ceramic resonator and, therefore, takes up less space.

LOW FREQUENCY OSCILLATOR

Figure 6:
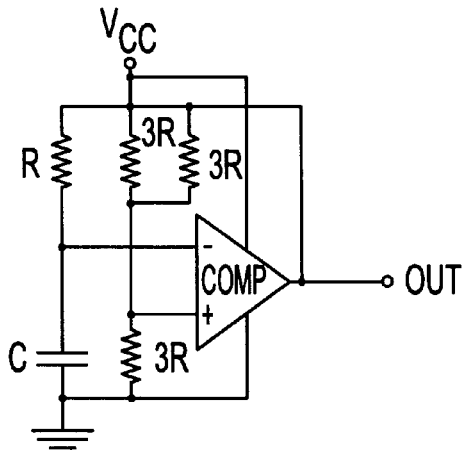
FIG. 6 is a schematic circuit diagram of the low speed fuze oscillator.

The low frequency oscillator (8 kHz in a preferred embodiment) used is a low current RC type using a comparator as shown in FIG. 6. In a preferred embodiment, where R=300K, C=12 pF and the comparator used is a Maxim MAX954, the oscillator starts up in about 125 usec (without requiring a jump start) and consumes about 20 uA from the 3.3 volt power buss.

DETONATION CIRCUIT

The microcontroller timer counts down using the low speed fuze oscillator (8 kHz in a preferred embodiment). Using the low speed fuze oscillator, the total fuze electronics draws less than 50 uA and can run for 10 seconds from its piezoid power supply. When the count down time is completed, the microcontroller reconfigures the assigned port from an input to an output (which helps prevent premature detonation) and drives it high. This activates a MOS switch ($Q_1$ in FIGS. 7A and 7B, or alternatively an SCR) which pulls one side of the detonator to ground, thereby causing the detonator to explode.

The other side of the detonator is connected to the detonator capacitor, $C_D$, which was charged to about 11.5 volts at the time of the propellant firing. Since $C_D$ is equal to 10 uF, it still retains at least 7 volts after 10 seconds which is an energy of 2450 ergs. The "all fire" M-100 detonator energy of 1000 ergs is exceeded by 2:1, so the detonator is reliably fired. If the safe & arm has activated by this point, the warhead is activated.

Figure 7A:
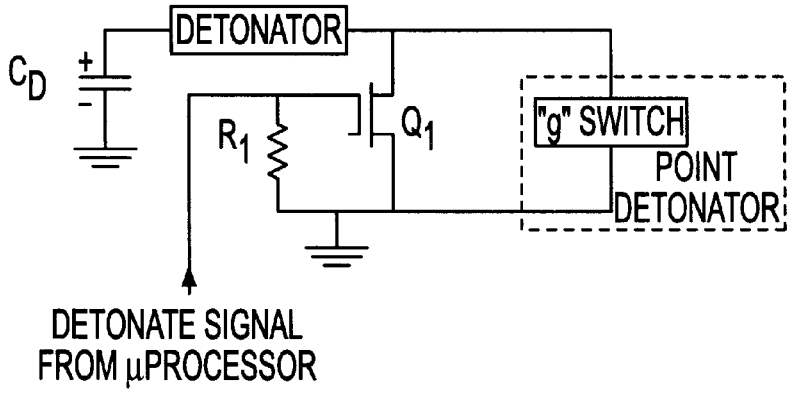
FIG. 7*a* is a schematic circuit diagram of the detonator circuit with a mechanical point detonator.
Figure 7B:
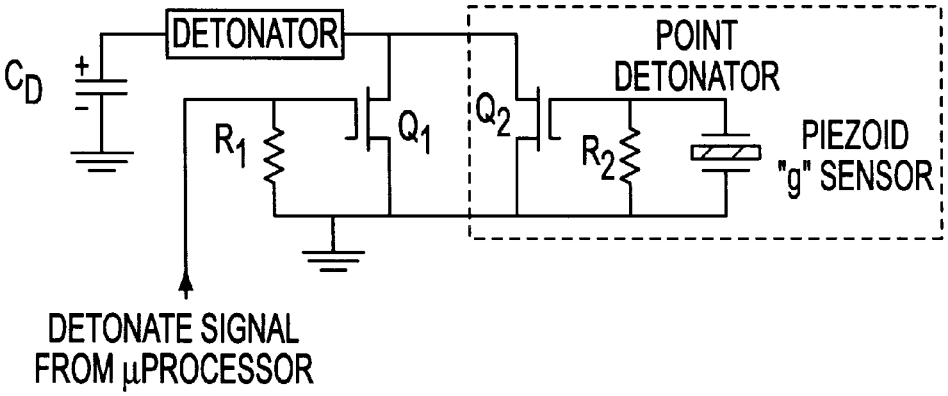
FIG. 7*b* is a schematic circuit diagram of the detonator circuit with a piezoid/MOS switch point detonator.

A back-up point detonation (impact) mode is provided. The point detonate switch can either be a gravity force ("g") sensitive switch, as shown in FIG. 7*a*, or a piezoid trigger as shown in FIG. 7*b*. Either one is activated when sufficient set forward force or side force acceleration is encountered and the MOS or SCR switch or the "g" switch fires the detonator, again using the detonator capacitor as shown. This provides a separate back-up mode in case the projectile hits short of the programmed range or if an electronic malfunction occurs that prevents proper timer operation.

In high speed mode, only two elements (the microcontroller and the high frequency gate) run at high speed (16 MHz in a preferred embodiment) which means that only about 10 mA is drawn dynamically. In time out mode (in which the fuze electronics counts down until it detonates the projectile), the accurate ultra low-power fuze electronics has a low current draw of about 40 uA (10 uA for the 8 kHz oscillator+15 uA for the microcontroller+10 uA for the DC/DC converter+5 uA for miscellaneous components) from the 3.3 volt buss. Consequently, this invention makes possible a "smart" yet safe, reliable and cost effective fuze electronics that can operate from only a piezoid that is activated by setback.

While there are shown and described present preferred embodiments of the invention, it is distinctly understood that the invention is not limited thereto, but may be otherwise variously embodied and practiced within the scope of the following claims.

What we claim as our invention:

1. An accurate ultra low power fuze apparatus comprising:

a piezoid power supply;

fuze electronics;

a power conditioner for supply power to said fuze electronics, said power conditioner having an input and an output, said input of said power conditioner is connected and electrically coupled to said piezoid power supply;

a data conditioner having an input for receiving a transmitted modulated signal and an output for transmitting an encoded burst time data word;

a detonation circuit;

a high speed fuze oscillator;

a low speed fuze oscillator;

a back-up point detonation circuit using a gravity force sensitive switch or piezoid sensor;

a microcontroller having a Vcc supply voltage input; and two external switches, switch A and switch B;

wherein said output of said power conditioner is connected and electrically coupled to said low speed fuze oscillator, said high speed fuze oscillator, said microcontroller, and said detonation circuit for supplying power thereto;

said switch A has two inputs, an output and a switch control and switch B has two inputs, an output and a switch control;

said switch control of switch A is connected and electrically coupled to a first clock select input on said microcontroller;

said switch control of switch B is connected and electrically coupled to a second clock select input on said microcontroller;

said output of switch A is connected and electrically coupled to a clock input on said microcontroller;

said output of switch B is connected and electrically coupled to a count input of said microcontroller;

said high speed fuse oscillator is connected and electrically coupled to said first input of switch A and to said first input of switch B, whereby said microcontroller sets the controls of switch A so that said high speed oscillator is connected to the "clock" input of the microcontroller, thereby providing a "clock" signal for the microcontroller;

said output of said data conditioner is connected and electrically coupled to a data input of said microcontroller and to said switch control of said switch B, whereby the first rising edge of an encoded burst time data word output by said data conditioner activates said switch control of said switch B, thereby causing the high speed fuze oscillator clock pulses to be gated into the microcontroller "count" input, and furthermore, the encoded burst time data word is read into a "data" input of the microcontroller where it is decoded and the result stored;

an increment output of said microcontroller is connected to a second input of said switch B, whereby the microcontroller calculates the error contained in said high speed fuze oscillator activating an incremental count through said control of said switch B, combining this result with the count in the counter and storing the result;

said low speed fuse oscillator is connected and electrically coupled to said second input of said switch A and to a Cal input of said microcontroller, whereby said microcontroller calculates the error contained in said low speed fuse oscillator by internally counting instruction cycles for a given number of low speed fuse oscillator cycles and determines and stores low speed fuse oscillator clock error relative to the high speed fuze clock error and corrects said burst time data word to account for both low speed and high speed fuse oscillator error;

said microcontroller having a detonate output which is connected and electrically coupled to said detonation circuit, whereby said detonator circuit is electrically fired when said microcontroller has completed count down.

2. The apparatus according to claim 1, wherein said microcontroller employs CMOS logic and said switch A and said switch B are low power/low voltage analog switches.

3. The apparatus according to claim 1, wherein said high speed fuze oscillator is a ceramic resonator.

4. The apparatus according to claim 1, wherein said high speed fuze oscillator is a surface mounted crystal.

5. The apparatus according to claim 1, wherein said high speed fuze oscillator is a CMOS oscillator.

6. The apparatus according to claim 1, wherein said low speed fuze oscillator is used is a low current RC oscillator using a "LV" series or equivalent CMOS logic chip comparator.

7. The apparatus according to claim 1, wherein said switch B further comprises a flip/flop, a high frequency gate, and a switch, said flip/flop having a clock input, a Q output, a set control and a reset control, said high frequency gate having two inputs and one output, said switch having one output connected and electrically coupled to a count input on said microcontroller, a switch control connected and electrically coupled to a count select input on said microcontroller, and two inputs, wherein one of said switch inputs is connected and electrically coupled to the increment output of said microcontroller and the other of said switch inputs is connected and electrically coupled to the output of said high frequency gate, the set control of the flip/flop is connected and electrically coupled to a port 1 output on said microcontroller, the reset control of the flip/flop is connected and electrically coupled to a port 2 output on said microcontroller, the clock input of the flip/flop is connected and electrically coupled to the output of the data conditioner, the Q output of the flip/flop is connected and electrically coupled to one input of said high frequency gate, and said high speed fuze oscillator is connected and electrically coupled to the other input of said high frequency gate.

8. The apparatus according to claim 1, wherein said power conditioner further comprises:

a storage capacitor $C_S$ having a positive and a negative terminal, a capacitor $C_D$ having a positive and a negative terminal, a capacitor $C_F$ having a positive and a negative terminal, a diode $D_1$ having an anode and a cathode, a diode $D_6$ having an anode and a cathode, a Zener diode $D_2$ having a cathode and an anode, a Zener diode $D_3$ having a cathode and an anode, and a DC/DC converter having a positive and a negative voltage input and a positive and a negative voltage output;

said negative terminal of said capacitors $C_S$, $C_D$ and $C_F$ are connected and electrically coupled to ground potential;

said anode of said Zener diode $D_3$ and said negative voltage input and said negative voltage output of said DC/DC converter are connected and electrically coupled to ground potential;

said positive terminal of said capacitor $C_S$ is connected and electrically coupled to said cathode of said diode $D_6$, said cathode of said Zener diode $D_2$, and said positive voltage input of said DC/DC converter;

said positive terminal of said storage capacitor $C_S$ is connected and electrically coupled to said piezoid power supply, whereby during setback said piezoid charges capacitor $C_S$ through said diode $D_6$ and $C_D$, through diode $D_1$;

said cathode of said diode $D_1$ is connected and electrically couple to said positive terminal of said capacitor $C_D$ and to said supply voltage input of said detonator;

said anode of Zener diode $D_2$ is connected and electrically coupled to said positive terminal of capacitor $C_F$, said cathode of Zener diode $D_3$, and to said positive voltage output of said DC/DC Converter, whereby a 3.3 volt supply voltage is provided at the positive voltage output of said DC/DC Converter;

said positive voltage output of said DC/DC Converter is connected and electrically coupled to said $V_{CC}$ supply voltage input of said microcontroller.

9. The apparatus according to claim 8, wherein said power conditioner further comprises a diode $D_5$ having an anode and a cathode and a battery, and said battery is connected to said anode of diode $D_5$ and said cathode of diode $D_5$ is connected to said positive voltage input of said DC/DC converter.

10. The apparatus according to claim 8, wherein said power conditioner further comprises a capacitor $C_J$ having a positive and a negative terminal and a diode $D_4$ having an anode and a cathode;

said positive terminal of said capacitor $C_S$ is connected and electrically coupled to said positive terminal of said capacitor $C_J$;

said anode of diode $D_4$ is connected and electrically coupled to said cathode of Zener diode $D_3$ said cathode of diode $D_4$ is connected and electrically coupled to said negative terminal of said capacitor $C_J$, whereby an 11.5 volt "jump start" can be provided at said cathode of said diode $D_4$ if needed.

11. The apparatus according to claim 8, wherein said DC/DC converter is a "LV" series or equivalent CMOS logic chip.

12. The apparatus according to claim 1, wherein the data conditioner further comprises:

an inductive pick-up coil, a first capacitor, a first resistor, a full wave bridge rectifier having an input and an output, a second capacitor having a first and a second terminal, a second resistor having a first and a second terminal, an inductor having a first and a second terminal, and a diode having a cathode and an anode;

said inductive pick-up coil is connected in parallel and electrically coupled to said first capacitor, said first resistor and the input of said full wave bridge rectifier;

the first terminal of said inductor is connected and electrically coupled to the output of said full wave bridge rectifier, whereby the signal demodulated by the full wave bridge rectifier is transferred to an LC filter;

the second terminal of said inductor is connected and electrically coupled to the anode of said diode, the second terminal of said second capacitor and the second terminal of said second resistor and to said the data input of said microcontroller;

said cathode of said second diode is connected and electrically coupled to Vcc supply voltage input of said microcontroller, whereby the data pulses will put power into the Vcc supply voltage input if the data conditioner is overdriven.

13. The apparatus according to claim 12, wherein said pick-up coil has an inductance of 5 uH and comprises 9 turns of small copper wire, said first capacitor is 1000 pF, said first resistor is 430 ohms, said inductor is 100 uH and said second capacitor is 1000 pF.

14. The apparatus according to claim 1, wherein the detonation circuit further comprises a MOSFET or SCR switch having a gate, a source and a drain, a detonator having a first and a second end, a capacitor having a positive and a negative terminal, and a resistor having a first and a second terminal;

said source of said MOSFET or SCR switch is connected to ground potential;

said resistor is connected between said gate and said source of said MOSFET or SCR switch;

said positive terminal of said capacitor is connected and electrically coupled to said first end of said detonator;

said negative terminal of said capacitor is connected and electrically coupled to ground potential;

said drain of said MOSFET or SCR switch is connected and electrically coupled to said second end of said detonator;

said gate of said MOSFET or SCR switch is connected and electrically coupled to said detonate output from said microcontroller, whereby when said output from said microcontroller goes "HIGH," said MOSFET or SCR switch closes and pulls one side of the detonator to ground, thereby exploding it.

15. The apparatus according to claim 14, wherein the detonator circuit further comprises a point sensitive switch connected between and electrically coupled to ground and said second end of said detonator, whereby said point sensitive switch is activated when hits short of a programmed range and pulls one side of the detonator to ground, thereby exploding it.

16. The apparatus according to claim 15, wherein said point sensitive switch is a gravity force sensitive switch.

17. The apparatus according to claim 15, wherein said point sensitive switch is piezoid trigger.

* * * * *

UNITED STATES PATENT AND TRADEMARK OFFICE

CERTIFICATE OF CORRECTION

PATENT NO : 5,942,714

DATED : August 24, 1999

INVENTOR(S) : Oberlin et al.

It is certified that error appears in the above-identified patent and that said Letters Patent is hereby corrected as shown below:

On the title page, item [57], in the Abstract, line 1, fuse should read --fuze--.

In the Abstract, line 19, clown should read --down--.

Column 1, line 65, $10_6$ should read --$10^6$---.

Column 4, line 4, change the detonator capacitor, the filter capacitor to --the detonator capacitor and the filter capacitor--.

In Column 6, line 10, change fuse to --fuze--.

Signed and Sealed this

Twenty-fifth Day of July, 2000

*Attest:*

*Attesting Officer*

Q. TODD DICKINSON

*Director of Patents and Trademarks*